United States Patent [19]

Huang

[11] Patent Number: 4,570,919

[45] Date of Patent: Feb. 18, 1986

[54] SELECTOR FOR MULTIBIN SHEET FEEDER

[75] Inventor: Lawrence K. Huang, Fremont, Calif.

[73] Assignee: Qume Corporation, San Jose, Calif.

[21] Appl. No.: 612,827

[22] Filed: May 23, 1984

[51] Int. Cl.[4] ..... B65H 5/26; B65H 1/28

[52] U.S. Cl. ..... 271/9; 271/114; 400/624; 400/605; 400/636.2; 400/649; 192/0.03; 192/0.07; 192/0.098; 192/48.9

[58] Field of Search ..... 271/9, 10, 116, 114; 400/608.2, 605, 624, 625, 630, 631, 649, 636.2, 608.4; 74/126; 192/0.03, 0.07, 0.098, 48.9, 48.6

[56] References Cited

U.S. PATENT DOCUMENTS

| | | | |
|---|---|---|---|
| 4,084,805 | 4/1978 | Simpson | 400/625 |
| 4,222,557 | 9/1980 | Wu | 400/625 |
| 4,475,731 | 10/1984 | Wood | 271/9 |

*Primary Examiner*—Bruce H. Stoner, Jr.
*Assistant Examiner*—James E. Barlow
*Attorney, Agent, or Firm*—T. L. Peterson; J. M. May

[57] ABSTRACT

An improved selector mechanism is described for use in a sheet feeder that has a plurality of bins and a feedout roller shaft associated with each bin, for selecting which of the feedout rollers to rotate, the selection being made by determining the angles at which rotation of a drive member is reversed. Each selector includes a cam assembly connected to the feedout roller shaft by a one-way clutch, and a driven driver which is freely rotatable on the shaft. The driver carries a pivotally mounted arm. The cam assembly has a deflector which moves the arm to a deflected position when the arm rotates in a nonfeed direction, and also carries an arm engager which engages the deflected arm when the driver reverses rotation after the arm is deflected, so the driver rotates the cam and, therefore, the feedout roller shaft in a feed direction. The cam also carries an undeflector which moves the arm back to its undeflected position if the driver rotates too far beyond the point of its encounter with the deflector. The cam includes a groove that receives a follower on the driver, to position the cam assembly and driver in known angular positions before reversal of the driver.

8 Claims, 7 Drawing Figures

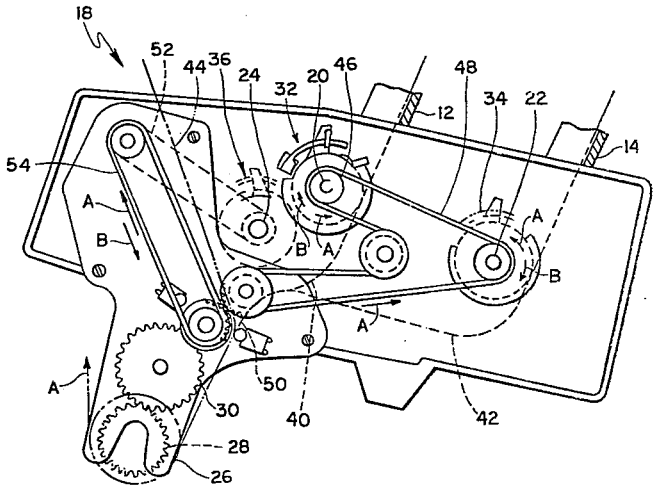

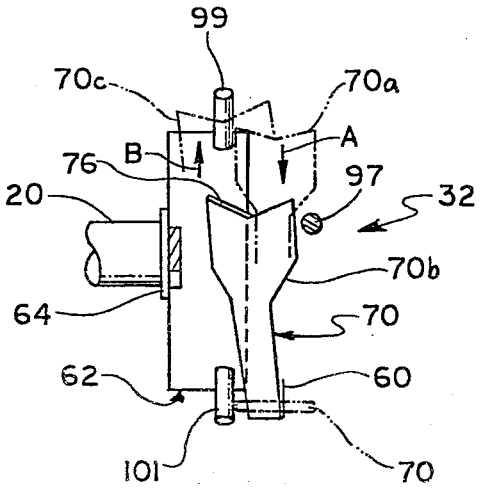
FIG. 5
FIG. 7
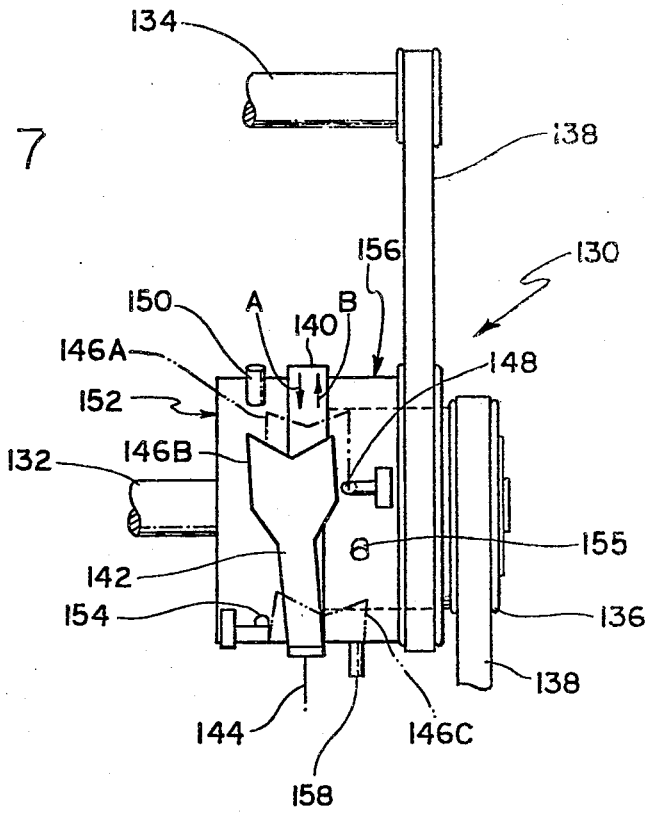

SELECTOR FOR MULTIBIN SHEET FEEDER

BACKGROUND OF THE INVENTION

A paper feeder which feeds paper into the platen of a printer, can have more than one bin and a mechanism for selecting which of the bins from which to feed out a sheet of paper or envelope. The paper feeder can be driven by the platen of the printer, and a particular bin can be selected by reversing the direction of rotation of the platen a plurality of times, with the particular angle at which at least one of the reversals occurs determining which of the bins is selected. U.S. Pat. No. 4,248,415 by Steinhilber describes a selector mechanism associated with each paper bin for making such selection. However, the particular mechanism in each selector is relatively delicate. A selector mechanism of greater ruggedness, for the selection of shafts to be rotated by control of the angle of reversals of rotation of the selector mechanism, would be useful in paper feeders and other mechanisms.

SUMMARY OF THE INVENTION

In accordance with one embodiment of the present invention, a selector is provided, which can be used to drive a feed roller shaft of a paper feeder, which rotates a shaft in a first direction only when a drive which powers the selector reverses direction at selected angular positions. The selector includes a cam assembly coupled to the shaft and a driver which has a drive frame freely rotatable on the shaft and drivable in opposite directions. An arm is pivotally mounted on the driver frame about an axis that is largely perpendicular to the axis of the shaft. A deflector on the cam assembly deflects an outer end of the arm to a deflected position when the arm rotates with the drive frame in a second direction past the deflector. If the drive frame reverses direction immediately after arm deflection, then the deflected arm will engage an arm engager on the cam assembly to rotate the cam assembly in the first direction. However, if the driver frame continues rotating in the second direction after the arm has been deflected, then the arm will engage an undeflector on the cam assembly which will restore the arm to its undeflected position.

The cam assembly can include a cam track which is engaged by a follower extending from the driver frame and movable in radial directions thereon. When the drive rotates in the second direction by more than a small amount, the follower will engage a stop at a home position along the cam track and rotate the cam indefinitely in the second direction. When the driver reverses and rotates a limited angle such as 90° in the first direction, it can then reverse again and rotate a much larger angle such as 360° in the second direction without again encountering the stop at the home position of the cam track.

The novel features of the invention are set forth with particularity in the appended claims. The invention will best be understood from the following description when read in connection with the accompanying drawings.

BRIEF DESCRIPTION OF THE DRAWINGS

FIG. 5 is a partial plan view of the selector of FIG. 4, showing its manner of operation.

FIG. 7 is a plan view of a selector constructed in accordance with another embodiment of the invention.

DESCRIPTION OF THE PREFERRED EMBODIMENTS

Figure 1:
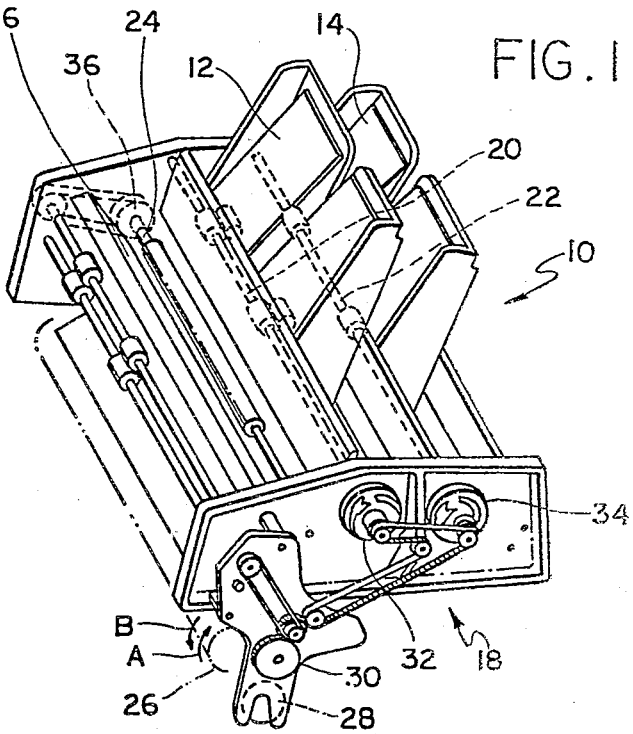
FIG. 1 is a perspective view of a paper feeder constructed in accordance with the present invention.

FIG. 1 illustrates a paper feeder 10 which has three bins 12, 14 and 16, which can each hold multiple sheets of paper (the bin 16 is designed to hold envelopes). A powerdriven feed mechanism 18 can turn any one of three feed roller shafts 20, 22, 24 to feed out a sheet from a corresponding bin. The paper feeder is designed for connection to a printer which has a platen 26. A sheet from a selected bin is fed behind the platen 26 to be rolled under and against the front of the platen. The platen is driven by a motor (not shown), and a gear 28 fixed to the platen shaft drives the feed mechanism 18.

When the platen is turning in the direction of arrow A to advance the paper that is printed upon, no new sheet is fed out from any of the bins. To feed a sheet out from a bin, after the platen has rotated by a considerable angle in the direction of arrow A in normal operation, the platen is reversed to rotate in the direction of arrow B by a limited angle such as 115°. The platen then reverses and rotates in the direction of arrow A by a selected angle such as 55°, 145° or 235°, to select one of the three bins 12, 14, 16. The platen then reverses again to rotate in the direction of arrow B to feed a sheet out of the selected bin. In this way, the paper feeder can be simply attached to the printer which includes the platen 26, by merely engaging the gear 28 with a gear 30 of the feed mechanism of the paper feeder.

Figure 2:
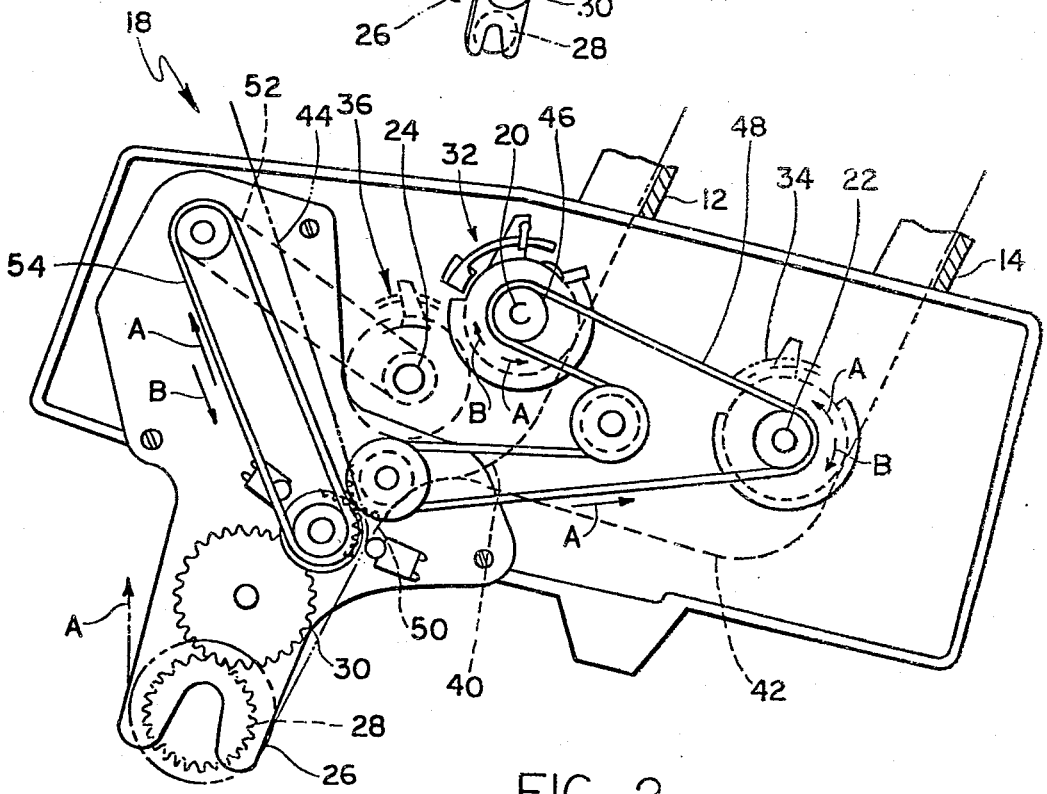
FIG. 2 is a partial side elevation view of the feeder of FIG. 1.

The feed mechanism 18 includes three selectors 32, 34 and 36 which are connected to corresponding feed roller shafts 20, 22 and 24 to drive a corresponding shaft when a selector is engaged. The paths of papers from the three bins are indicated in FIG. 2 by the lines 40, 42 and 44. Each of the selectors includes a drivable input element 46 which is motor driven through belts that are driven by the platen. The input elements of the selectors 32, 34 are driven through a belt 48 which is coupled through a gear train 50 to the first gear 30. The input element of the other selector 36 is driven through a pair of belts 52, 54 attached to a gear of the gear train 50.

Figure 3:
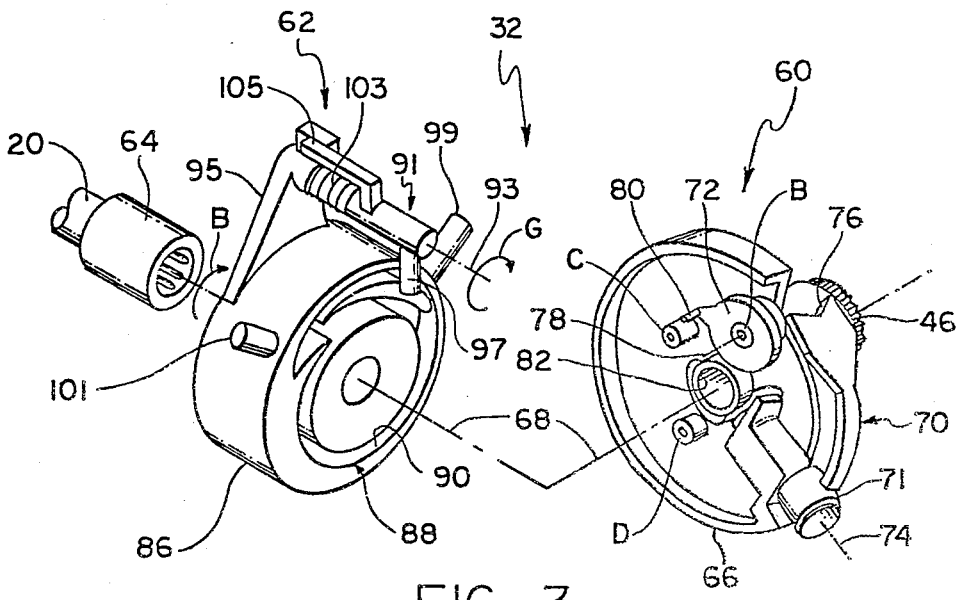
FIG. 3 is an exploded perspective view of one of the selectors of the feeder of FIG. 1.
Figure 4:
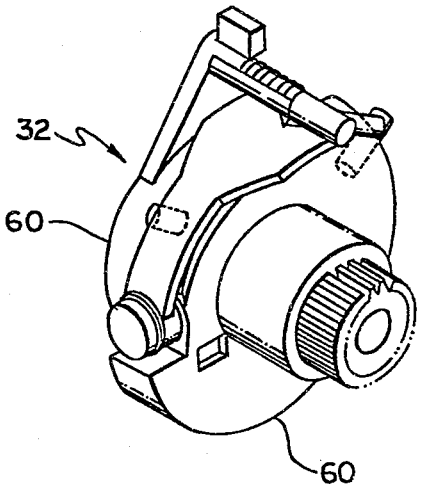
FIG. 4 is a perspective view of the selector of FIG. 3 in an assembled position.

FIGS. 3–5 illustrate details of one of the selectors 32, the others being identical. The selector includes a driver 60 and a feed cam assembly 62. The selector also includes a clutch 64, such as an over-running clutch, which is fixed to the cam assembly 62 and which engages the feed roller shaft 20 only during rotation of the cam assembly in the feed direction B. The driver 60 includes a driver frame 66 which can rotate about the drive axis 68 which is coincident with the axis of the shaft 20. The driver also includes an arm 70 and a follower device 72. The arm 70 has an inner end 71 that is pivotally mounted about an arm axis 74 that extends primarily perpendicular to the shaft axis 68. The arm has an opposite outer end which forms a pusher 76. The follower device 72 is pivotally mounted about a follower axis 78, to permit a follower 80 on the device to move largely radially towards and away from the shaft axis 68. The driver frame 66 has a bearing 82 at its center that allows the drive frame to rotate freely about the feed roller shaft 20 on which the frame is disposed.

The cam assembly 62 includes a cam body 86 which has a cam face or cam 88 facing the driver and having a groove 90 that forms a cam track that receives the follower 80 of the driver. The cam assembly also includes a deflector device 91 which is pivotally mounted about an axis 93 on an upstanding leg 95 extending from the cam body. The deflector device includes a deflector 97 that can engage a side of the arm 70 of the driver to deflect it in a direction substantially parallel to the drive axis 68 to a deflected position wherein the outer end of the arm can engage an arm engager 99 in the form of a pin that extends from the cam body. The cam assembly also includes an undeflector 101 in the form of a second pin extending from the cam body, which can deflect the arm back to its undeflected position. The deflector device 91 includes a coil spring 103 that urges the deflector to turn in the direction G until a stop 105 on the deflector engages the top of the leg 95.

FIG. 5 shows the manner of operation of the selector 32, which allows the arm 70 of the driver to engage the arm engager 99 of the cam assembly only when the rotation of the driver is reversed at the proper angle of orientation relative to the cam assembly. It can be assumed that the driver and arm at 70*a* is moving in the nonfeed direction indicated by arrow A. The arm will assume the nondeflected position 70*a* because as it passes in the direction A past the engager pin 99, the pin will assure that the arm has been deflected to the position 70*a*. As the driver and arm continue to rotate in the direction of arrow A, the arm will encounter the deflector 97, which will deflect the arm to its deflected position shown at 70*b*. If the direction of driver rotation is immediately reversed to direction B, the pusher 76 at the end of the arm will engage the arm engager pin 99 to deflect the arm even further to its deflected position at 70*c*. Continued rotation of the driver and arm in the direction B will cause the pusher 76 at the end of the arm to push on the pin 99 that extends from the cam assembly to rotate the cam assembly in the direction B. As indicated for FIG. 3, when the cam assembly and the clutch 64 rotate in the direction B, the clutch engages the shaft 20 to rotate the shaft in the direction B. When the feed roller shaft 20 rotates in the direction B, it feeds a sheet out of a corresponding bin, so that the sheet is fed to the platen of the printer.

If, in FIG. 5, the driver and its deflected arm at 70*b* continue to rotate in the direction A after the arm has been deflected at 70*b*, the arm will soon encounter an undeflector 101. The undeflector 101 will return the arm to its undeflected position at 70*d*, so that the arm cannot drive the cam assembly. Thus, the combination of the pivoting arm 70 on the driver, and the deflector 97, arm engager 99, and undeflector 101 on the cam assembly, permit the feed roller shaft 20 to be driven in the feed direction only if the driver moving in the nonfeed direction A reverses at the proper angular position with respect to the cam assembly 62.

Figure 6:
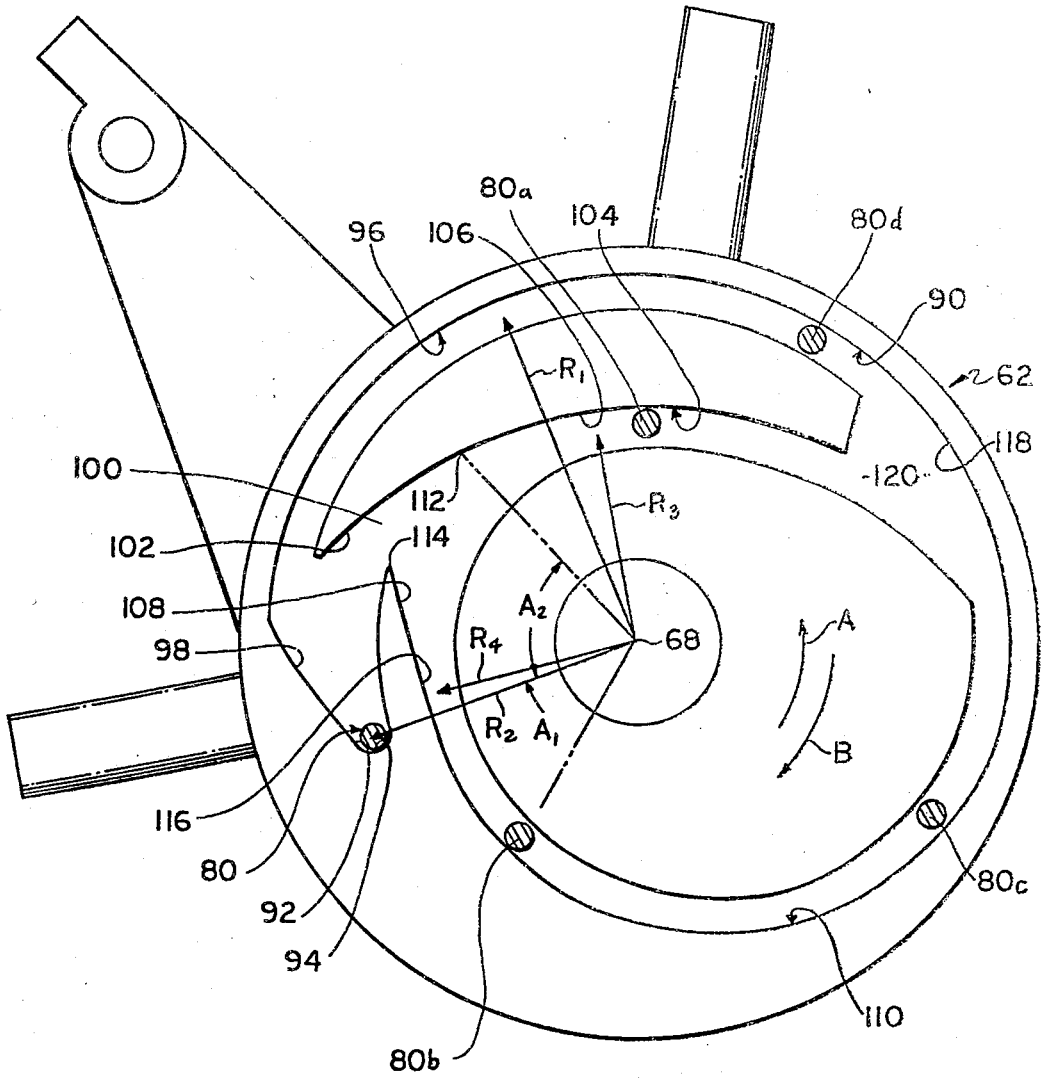
FIG. 6 is an enlarged elevation view of the cam of the selector of FIG. 3.

In order for reversal of arm rotation at 70*b* to result in rotation of the feed roller shaft, it is necessary that the cam assembly 62 lie in the configuration shown in FIG. 5 at the time of reversal of driver rotation. The rotation of the cam assembly 62 to this orientation is accomplished by the action of the follower 80 of FIG. 3 on the cam 88. FIG. 6 illustrates details of the groove cam track 90 which receives the follower pin or follower 80 of the driver. The groove includes a home location 92 lying adjacent to a stop 94 which engages a follower moving in the nonfeed direction A. When the follower engages the stop 94 at the home position, such engagement assures that the cam assembly 62 will rotate in the direction A during any further movement of the follower in this direction. In operation, all followers 80 are rotated by at least about $1\frac{1}{2}$ turns in the nonfeed direction A at the beginning of the selection process, to assure that all followers 80 lie at the home positions of their corresponding cams. Before a follower reaches the home position, it will be traveling at a maximum radius track section 96 which is at a radius $R_1$ that is the greatest of any portion of the groove. An intermediate track section 98 at the A direction end of the maximum radius track section, connects the maximum radius section to the home position 92 which is at a smaller radius $R_2$.

Continuing with the selection of one of the bins, when the driver is first reversed, the follower 80 is rotated in a feed direction B past a director region 100 that includes an outer director 102 that engages a follower moving away from the home position in a feed direction B, into a transition track section 104. The transition section 104 has a minimum radius $R_3$ at the location 106. After a rotation of the follower 80 from the home position 92 in the feed direction B by about 115° to the position shown at 80*a*, the direction of follower rotation is reversed again so the follower moves in the nonfeed direction A to a selected one of three positions 80*b*, 80*c*, or 80*d*. In the movement of the follower from 80*a* in the nonfeed direction A to a position such as 80*b*, the follower is diverted by an inner diverter 108 into a spiral track section 110, instead of back to the home position 92. So long as the follower has previously rotated in the feed direction B past the point 112 which has a radius approximately equal to the tip 114 of the inner diverter, a reversal of the follower will assure that it enters the spiral track section 110 instead of moving back to the home position. The point 112 is at an angle $A_2$ which is much less than 180° from the home position, the angle $A_2$ in FIG. 6 being about 70°.

The spiral track section 110 has a minimum radius $R_4$ at its nonfeed end 116. The radius of the spiral track section increases in the nonfeed direction A, until it has a maximum radius at 118 which is the feed end of the spiral track section. For a follower moving in the A direction out of the nonfeed end 118 of the spiral track, that follower will pass through an intersection 120 in the groove track and enter the maximum radius track section 96. Continued movement in the A direction will cause the follower to encounter the stop 94 in the home position. On the other hand, the follower lying along the spiral track section 110 and moving in the feed direction B, will move in an endless closed path, along the spiral section 110 and the transition track section 106. The only way the driver (which includes follower 80) moving in direction B can then engage the cam assembly is through the pivoting arm 70.

In the first select position 80*b* of the follower, the follower lies at an angle $A_1$ such as 40° in the nonfeed direction A from the home position 92. For this position of the driver, and its follower, relative to the stop 94 on the cam assembly, the driver and cam assembly will have the particular orientation shown in solid lines in FIG. 5, wherein the arm is at the position 70*b*. A reversal of driver rotation to the feed direction B at this point, will cause the arm to engage the arm engager 99 and allow the driver to drive the cam and therefore the feed roller shaft 20, to feed a sheet of paper out of a corresponding bin.

The arm can be in the position 70*b* in FIG. 5 when the follower in FIG. 6 is at the position 80*b*, only for the first selector 32 (FIG. 2) associated with the first bin 12. The position 70*b* in FIG. 5, will exist for the second selector only when the follower is near the position 80*c*. Similarly, the position of the arm at 70*b* will exist for the third selector only when the follower is near the position 80*d*. As shown in FIG. 3, the driver has three mounts labeled B, C, and D for holding the follower device 72 and the follower 80 thereon, which determine which of the positions 80*b*, 80*c* or 80*d* will be required to cause the arm to be in position to engage the arm engager upon the next reversal of the drive. In the particular example shown in FIG. 6, the follower positions 80*b*, 80*c* and 80*d* are spaced 90° apart.

The mechanism of the selector is rugged and reliable. Except for a coil spring (which is a reliable type of device) in FIG. 3 of the deflector device 92, all parts of the selector mechanism can be formed of rigid material. In particular, a pivoting arm 70 is relatively large, but does not result in a selector of large diameter, because the arm 70 extends primarily in a circumferential direction (perpendicular to a radius) between its pivotally mounted inner end 71 and the pusher 76 at its outer end. The only necessary frictional drive between the follower 80 of the driver and the cam assembly, occurs during movement of the follower between the home position 92 and a release position shown at 80*a* in FIG. 6. This frictional drag is very small because the follower 80 is part of a light weight follower device 72 which is pivotally mounted on a mount B of small diameter compared to the diameter of the feed roller shaft 20 on which the cam assembly is mounted and the much larger mass of the cam assembly. The considerable force required to turn the feed rollers to feed a sheet of paper out of bin, is transmitted through the relatively large arm 70 and a relatively sturdy pin 99 of the cam assembly.

FIG. 7 illustrates a dual selector mechanism 130 which can select one of two feed roller shafts 132, 134 to turn to feed out a sheet of paper from a corresponding bin associated with the shaft. The selector includes an input element 136 that is driven by a belt 138, and which is connected to a driver 140 to drive it in feed and nonfeed directions B and A. An arm 142 pivotally mounted about an arm axis 144 on the driver frame, can pivot between an undeflected position wherein its pusher end is at 146A, to a first deflected position shown in solid lines at 146B, and to a second deflected position indicated at 146C. With the arm at the undeflected position 146A, movement of the driver in the direction A causes a first deflector 148 to pivot the arm to the position 146B. If the driver is immediately reversed, the pusher end of the arm will engage a first arm-engaging pin 150 on a cam assembly 152 to drive the first shaft 132 in the feed direction B. However, if the arm with an end at 146B continues to rotate in a direction A, then it will encounter a second deflector 154, which will deflect the arm to the position 146C.

If the driver and the arm at 146C is reversed to move in the feed direction B, the arm end at 146C will encounter a second arm engager 155 and the arm will turn a second cam assembly 156 in the feed direction. The cam assembly 156 is connected through a second belt 158 to the second feed roller shaft 134, to turn it. If the driver with the arm end at 146C continues to rotate in the nonfeed direction A, then the arm will encounter an undeflector 158 which will return the arm to the undeflected position corresponding to 146A. The deflectors 148 and 154 are similar to a deflector 92 of FIG. 3, in that they deflect the arm only when it is moving in the nonfeed direction A, and allow the arm to pass thereacross when it is moving in the opposite direction B. The driver 140 has two follower devices (not shown) similar to the device 72, which engage cam groove tracks similar to that shown in 90 in FIG. 6, (but with one being a mirror image of 90), on each of the cam assemblies 142, 156.

Thus, the invention provides a selector with an input element which is driven in reverse directions, which will drive an output shaft such as a feed roller shaft of a paper feeder, when rotation of the input element reverses direction at a particular angle after the last reversal of direction. The selector can include a driver which carries an arm with an inner end pivotally mounted about an axis that is largely perpendicular to the axis of the output shaft and which has an opposite end forming a pusher. The selector can also include at least one cam assembly coupled through a one way clutch to the output shaft. A deflector mounted on a cam assembly deflects the pusher end of the arm to a deflected position, so that if the driver is immediately reversed the pusher end of the arm will engage an arm engager on a cam assembly to drive that cam assembly. However, if the deflected cam continues to rotate without reversal, then it will soon encounter an undeflector which will move the pusher end of the arm away from the deflected position so it cannot drive the cam assembly with the arm engager in a feed direction.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In a paper feeder which can connect to a platen drive to feed paper from a selected one of a plurality of paper bins to a platen, with the selection of the bin and driving of a feed roller shaft of the selected bin accomplished by reversals of the platen drive mechanism, the improvement comprising:

a plurality of selectors, each associated with one of said bins, each selector having a drivable input element which can be driven to rotate in either of two opposite directions (A) and (B), and means for coupling the input element to the shaft of a corresponding paper bin; and means for connecting said platen drive to said input elements;

each selector including a cam assembly which can rotate about a drive axis, a one-way clutch which connects said cam assembly to a corresponding feed roller shaft only during rotation of the cam assembly in a predetermined feed direction (B), and a driver which includes said drivable input element;

said driver including a driver frame which is rotatable about said predetermined axis, and an arm pivotally mounted on said driver frame about an arm axis that is largely perpendicular to said drive axis and which has a pusher spaced from its arm axis;

said cam assembly including a deflector which can move said arm in a direction largely parallel to said drive axis from an undeflected position to a deflected position during rotation of said driver relative to said cam assembly in a nonfeed direction (A) which is opposite to said feed direction (B), and said cam assembly including an arm engager which engages said pusher on said arm only when said arm is in said deflected position and said driver assembly rotates in said feed direction (B), to then rotate the cam assembly in said feed direction;

said cam assembly also including an undeflector which moves said arm back to said undeflected position when said driver rotates a predetermined angle past the position at which said deflector moves said arm to said deflected position, whereby to engage said arm with said arm engager only when the driver is reversed from rotation in the nonfeed direction (A) to the feed direction (B) at close to a particular angular position of the driver.

2. The improvement described in claim 1 wherein;

said cam assembly includes a cam which forms a track extending in largely circumferential directions about said drive axis, and said driver assembly includes a follower engaged with said track, said track including a stop at a predetermined radial distance from said driver axis, said stop positioned to engage said follower when the driver assembly rotates in said nonfeed direction (A);

said track including a home location adjacent to said stop, a maximum radius track section of greater radius from said driver axis then said home location and angularly spaced in said feed direction (B) from said home location and connected by an intermediate track section to said home location, a spiral track section extending to said maximum radius track section and which increases in radius between a feed end which is of smallest radius and a nonfeed end at said maximum radius track section, a transition track section radially inwardly spaced from said maximum track section and connecting said nonfeed end and said feed end of said spiral track section, and diverter means connecting the home location and the intersection between said feed end of spiral track section and said transition track section for diverting the follower into said transition track section when the follower moves in the feed direction (B) away from the home position and for diverting the follower into the nonfeed end of the spiral track section when the follower moves in the nonfeed direction (A) out of the transition track section.

3. A paper feeder cam assembly which receives a follower that is driven to rotate in opposite directions (A) and (B) about a driver axis, to cause the cam assembly to normally rotate with the follower during unlimited follower rotation in a nonfeed direction (A), but to disengage them and allow the follower to rotate in said nonfeed direction (A) by more than 180° without driving the cam assembly to rotate, by first reversing the follower to rotate in an opposite feed direction (B) by at least a limited angle which is much less than 180°, comprising:

a cam which has a stop which can engage said follower when it rotates in said nonfeed direction (A), said cam having a follower-engaging track which includes a home location adjacent to said stop, a maximum radius track section of greater radius from said driver axis than said home location and angularly spaced in said feed direction (B) from said home location and connected by an intermediate track section to said home location, a spiral track section extending to said maximum radius track section and which increases in radius beween a feed end which is of smallest radius and a nonfeed end at said maximum radius track section, a transition track section largely lying radially inside said maximum radius track section and connecting said feed and nonfeed ends of said spiral track section, and diverter means connecting the home location and the intersection between said feed end of spiral track section and said transition track section for diverting the follower into said transition track section when the follower moves in the feed direction (B) away from the home position and for diverting the follower into the nonfeed end of the spiral track section when the follower moves in the nonfeed direction (A) out of the transition track section.

4. The paper feeder cam assembly described in claim 3 including:

a driver frame which is rotatable about said driver axis and which carries said follower, and an arm pivotally mounted on said driver frame about an arm axis which is primarily perpendicular to said driver axis, the arm having an outer end spaced from said arm axis and forming a pusher;

said cam carrying an arm engager and a deflector, the deflector positioned to pivot said arm from a nondeflected to a deflected position when the deflector engages the arm during driver frame movement in said nonfeed direction (A), and said arm engager positioned to engage said arm when the arm is in said deflected position and the driver frame is moving in said feed direction (B), so that a reversal of frame rotation at the proper position can cause cam assembly rotation in the feed direction.

5. The paper feeder described in claim 4 wherein:

said cam carries an undeflector which engages a deflected arm and returns it to said undeflected position when the driver frame is turning in said nonfeed direction (A), said undeflector located so said arm can engage it after the arm moves a predetermined angle of less than 180° in the nonfeed direction (A) after being deflected by said deflector, whereby the cam assembly will be driven in the feed direction only if the driver frame reverse its rotation from the nonfeed direction (A) to the feed direction (B) while the arm is within said predetermined angle.

6. A paper feeder selector assembly comprising:

a driver which can rotate freely on a shaft in feed and nonfeed directions (B), (A), and which has a drivable input element and a follower; and a cam assembly which is rotatably mounted on said shaft and which has a cam face with a groove that receives said follower;

said groove having a home location with a stop thereat that prevents follower rotation in said nonfeed direction (A) relative to said cam, a maximum radius groove section of greater radius from the shaft axis than the home location and spaced in the feed direction (A) from the home location, an intermediate groove section connecting a first end of the maximum radius section to the home position, a spiral groove section having a location of greatest radius connected to a second end of said maximum radius section, a transition section which has a first end substantially at the intersection of said maximum and spiral sections and a second end, and a diverter which connects together the home location, the second end of the transition section, and the smallest radius end of the spiral section.

7. A driven selector for driving an output shaft having a shaft axis, in a predetermined first direction (B) only upon reversals in the direction of selector rotation, comprising:

a first member which is disposed on said output shaft and is coupled to said shaft at least during rotation of the first member in a first direction (B);

a driver which is rotatably mounted on said shaft so it can rotate relative to said shaft, said driver having a driver frame which carries a drivable input element which can be driven to rotate it and said frame in either of two opposite directions (A) and (B);

said driver having an arm with an inner end pivotally mounted on said driver frame about an axis which is largely perpendicular to said shaft axis, said arm having an outer end forming a pusher;

said first member having a deflector which deflects said arm from an undeflected position to a deflected position when the arm moves in said second direction (A) past said deflector;

said first member carrying an arm engager which engages the deflected arm when it is moving in said first direction (B) after having reached said deflector and reversed its direction of rotation, said first member also carrying means which moves said arm at least to its undeflected position when the deflected arm continues moving in said second direction (A) after engaging said deflector.

8. The selector describe in claim 7 wherein:

said driver includes a follower which can move in at least a partially radial direction on the driver frame, and said first member includes a cam which forms a groove that engages said follower;

said groove having a home location with a stop thereat that prevents follower rotation in said second direction (A) relative to said cam, a maximum radius groove section of greater radius from the shaft axis that the home location and spaced in the first direction (B) from the home location, an intermediate section connecting a first end of the maximum section to the home position, a spiral section having a location of greatest radius connected to a second end of said maximum radius section, a transition section which has a first end substantially at the intersection of said maximum and spiral sections and a second end, and a diverter region which connects together the home location, the second end of the transition section, and the smallest radius end of the spiral section.

* * * * *